United States Patent [19]

Tabacco

[11] 4,368,663

[45] Jan. 18, 1983

[54] CHIMNEY DAMPER

[76] Inventor: Salvatore C. Tabacco, 6869 Indian Creek, West Bloomfield, Mich. 48033

[21] Appl. No.: 241,679

[22] Filed: Mar. 9, 1981

[51] Int. Cl.[3] ..... F23L 17/02

[52] U.S. Cl. ..... 98/59; 126/286; 98/85

[58] Field of Search ..... 126/288, 286, 289, 312; 98/59, 82, 85

[56] References Cited

U.S. PATENT DOCUMENTS

| | | | |
|---|---|---|---|
| 978,175 | 12/1910 | Lindemeyer | 98/59 |
| 1,720,789 | 7/1929 | Heusser | 98/59 |
| 3,267,832 | 8/1966 | Hinkle | 98/59 |
| 3,377,939 | 4/1968 | Sailors | 98/59 |
| 4,007,730 | 2/1977 | Heebink | 126/288 |
| 4,020,754 | 5/1977 | Dalsin | 126/286 |
| 4,165,679 | 8/1979 | Lyemance | 126/286 |

*Primary Examiner*—James C. Yeung
*Attorney, Agent, or Firm*—Gifford, VanOphem, Sheridan & Sprinkle

[57] ABSTRACT

A novel damper is provided which is attached to the top of a chimney flue for minimizing or altogether eliminating heat losses and air conditioning losses through the chimney flue when the chimney is not in use as well as preventing objects and/or animals from entering into the chimney. The damper comprises a substantially rectangular stamped frame having a central opening and a portion adapted to flatly abut against the top of a chimney flue. The frame further includes at least two and preferably four flanges extending downwardly from the central opening while screws threadably engage the flanges to secure the frame to the top of the chimney flue. A door is pivotally mounted to the frame and movable between an open and a closed position while a spring resiliently urges the door towards its open position. An elongated chain is connected at one end to the door, extends through the chimney flue and is accessible at its other end through a fireplace opening. To close the door, the chain is pulled downwardly and secured in its downward position by a pin attached within the fireplace opening.

8 Claims, 6 Drawing Figures

Fig-1
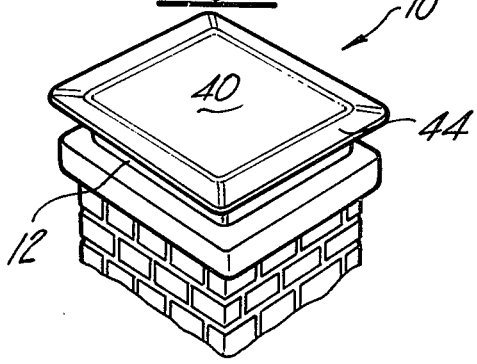
Fig-2
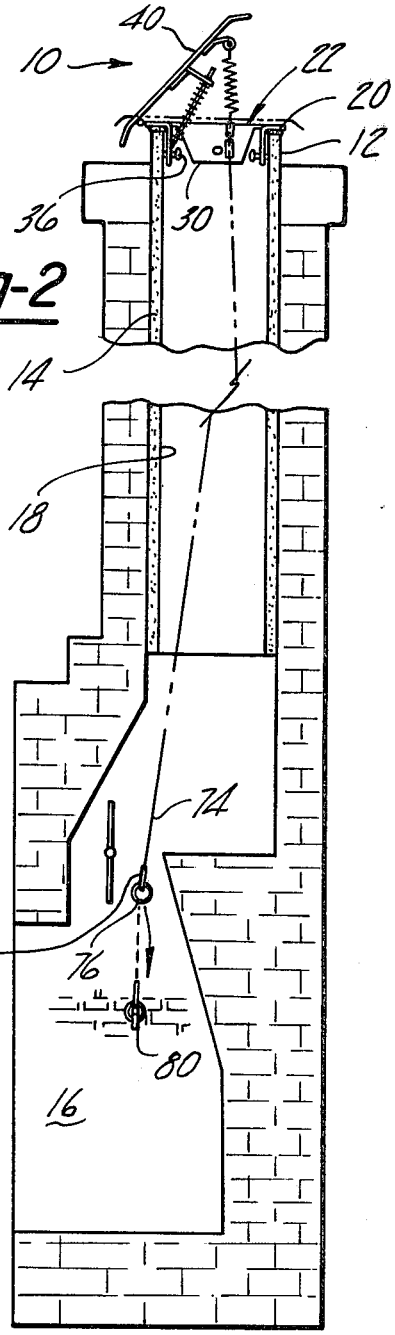
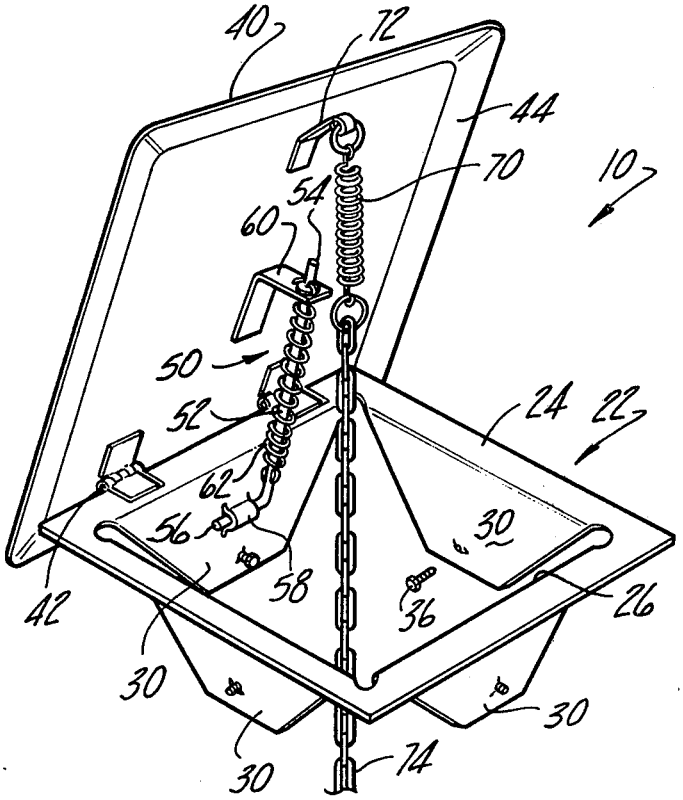
Fig-3
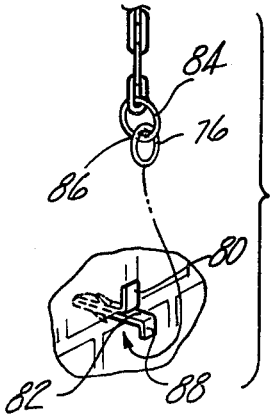
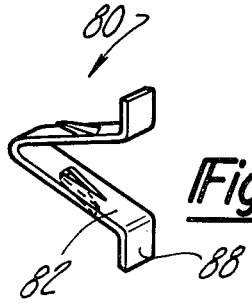
Fig-5

CHIMNEY DAMPER

BACKGROUND OF THE INVENTION

I. Field of the Invention

The present invention relates generally to chimney dampers and, more particularly, to such a damper attached to the top of a chimney flue.

II. Description of the Prior Art

In homes and other buildings having a fireplace, the fireplace opening or the like is connected by a chimney flue which is open at its upper end outside of the home. Thus, in use, the combustion products from the fireplace pass up through the flue and exteriorly of the building in the desired fashion.

When the fireplace is not in use, however, the fireplace opening and chimney flue form a passage through which heat can escape from the interior of the home. Although most fireplaces include dampers at the bottom of the flue and immediately above the fireplace opening, these dampers do not usually provide an adequate fluid seal for the chimney flues. Consequently, even when these dampers are closed, a great deal of heat loss still occurs through the chimney flue.

There have, however, been a number of previously known chimney dampers which are mounted on the top of the chimney. These previously known top mounted chimney dampers, however, have not proven entirely satisfactory in use.

One disadvantage of these previously known dampers is that these dampers oftentimes require cutting, drilling or other modifications of the chimney flue for their installation. While such modifications are not difficult to a stilled workman, the average homeowner is incapable of performing the necessary masonary work.

A still further disadvantage of these previously known top mounted dampers is that these dampers are constructed, by and large, from cast metal parts. Metal castings, however, not only entail high manufacturing costs but are also very heavy in construction. The heavy weight of these metal castings, furthermore, increases the difficulty in installing these dampers.

A still further disadvantage of many of the previously known dampers is that the upwardly exposed surface of the damper includes areas in which precipitation collects. Moreover, this water upon freezing can lock the damper in its closed position which creates a potential safety hazard for the fireplace.

SUMMARY OF THE PRESENT INVENTION

The present invention provides a top mounted chimney damper which overcomes all of the above mentioned disadvantages of the previously known top mounted dampers.

In brief, the damper according to the present invention comprises a generally rectangular frame having a central and preferably rectangular opening. The frame also includes a portion dimensioned to flatly abut against the top of a chimney flue and, in the preferred form of the invention, a sealant is disposed between this frame portion and the top of the chimney flue.

At least one and preferably four flanges which depend downwardly from the opposed sides of the central frame opening. Thus, with the frame positioned on the top of the chimney flue, these flanges extend downwardly and into the interior of the chimney flue. A threaded member threadably engages each flange and, upon tightening, abuts the interior of the chimney flue and secures the frame in place and to the chimney flue.

A door is pivotally mounted to one side of the frame and movable between an open and a closed position. In its closed position, the door entirely covers the frame opening while in its open position the door is spaced apart from the frame opening and permits the flow of hot gases through the chimney flue. Moreover, in the preferred form of the invention, the door is generally planar but includes a downwardly tapered portion around its outer periphery which prevents water accumulation on the frame.

A compression spring is installed between the frame and the door and urges the door toward its open position. In order to move the door to its closed position, a chain is attached at one end to the door and extend downwardly through the interior of the chimney flue. The lower end of the chain is accessible through the fireplace opening while a pin or hook mounted to the side of the fireplace which, when desired, engages the chain and holds the door in its closed position.

Both the frame and the door are constructed from metal stampings which reduce not only the manufacturing cost of the damper but also its weight.

BRIEF DESCRIPTION OF THE DRAWING

A better understanding of the present invention will be had upon reference to the following detailed description, when read in conjunction with the accompanying drawing, wherein like reference characters refer to like parts throughout the several views, and in which:

FIG. 1 is a perspective view illustrating a preferred embodiment of the damper mounted to a chimney;

FIG. 2 is a longitudinal sectional view illustrating the damper mounted to a chimney;

FIG. 3 is a perspective view similar to FIG. 1 but enlarged and illustrating the damper in its open position;

FIG. 5 is a perspective view illustrating a component of the damper assembly.

DETAILED DESCRIPTION OF A PREFERRED EMBODIMENT OF THE PRESENT INVENTION

Figures 4, 6:
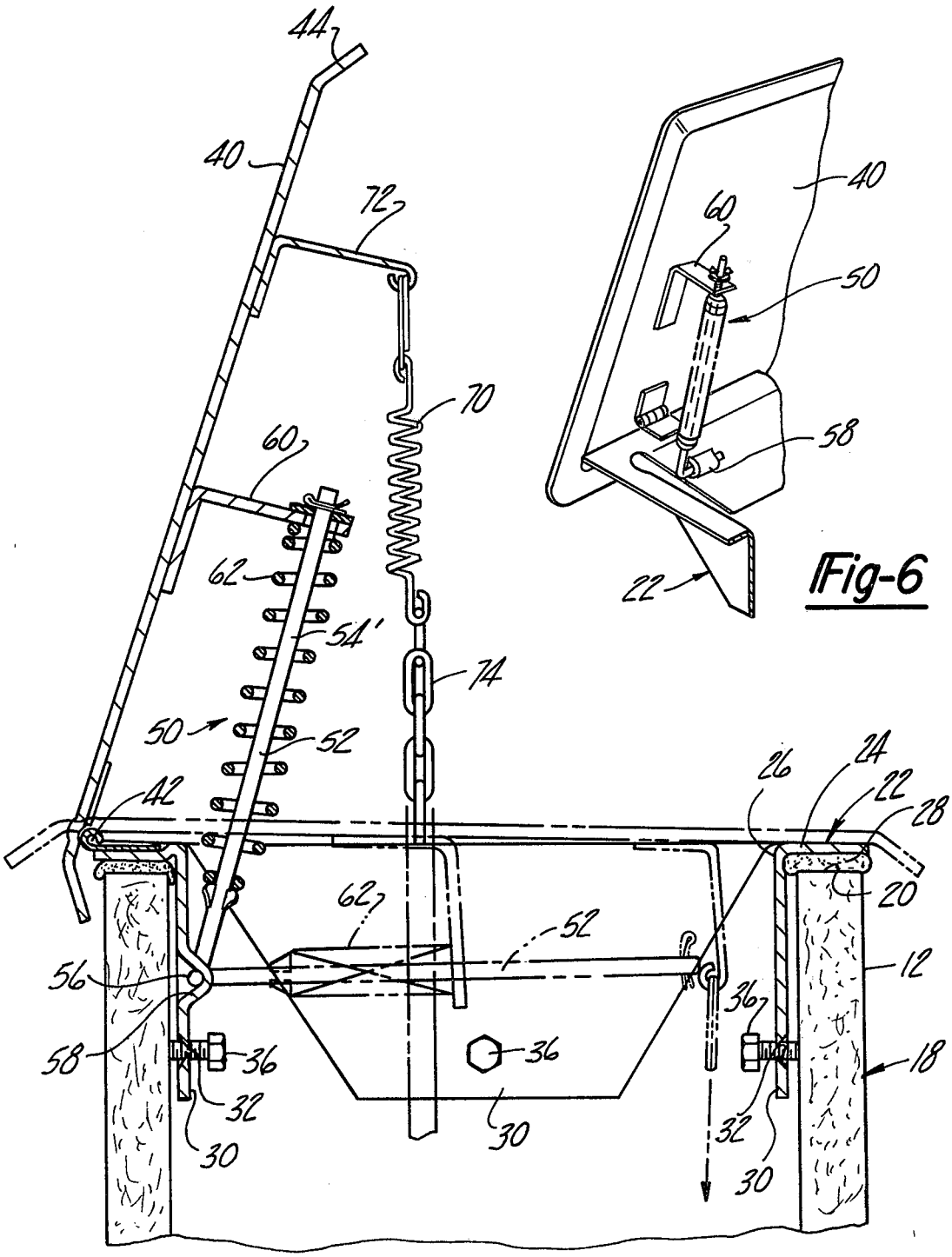
FIG. 4 is a sectional side view of the damper.
FIG. 6 is a fragmentary view similar to FIG. 3 but illustrating a modification thereof.

With reference first to FIG. 2, a preferred embodiment of the damper 10 according to the present invention is thereshown mounted on the top 12 of a chimney flue 14. The chimney flue 14 is of the type found in homes, office buildings and the like having a fireplace opening 16 at its lower end and an elongated flue pipe 18 extending from the top of the fireplace opening 16 and to the chimney top 12. Moreover, in most modern building, the flue pipe 18 and the chimney top 12 are of a standard size in construction, generally rectangular in shape and have an upper planar surface 20.

With reference now to FIGS. 1–4, the damper 10 further comprises a frame 22 having a generally rectangular portion 24 with a central rectangular opening 26. The frame 22 furthermore is dimensioned so that its rectangular portion 24 flatly abuts against the top surface 20 of the chimney flue 18 as best shown in FIG. 4. Furthermore, if desired, an adhesive 28 is disposed in between the rectangular portion 24 of the frame 22 and the top 20 of the chimney flue which forms a good seal between the chimney frame 22 and the top 12 of the chimney.

The frame 22 further comprises at least two, and preferably four downwardly depending flanges 30 wherein one flange depends downwardly from each side of the rectangular opening 26. Thus, with the frame 22 positioned on top of the chimney flue 18, these flanges 30 depend downwardly into the interior of the chimney and so that one flange 30 is substantially parallel to each side of the rectangular chimney flue.

Referring now particularly to FIG. 4, each flange 30 includes a hole 32 formed near its lower end. A screw or bolt 36 is then threaded through the hole 32 so that, upon tightening, the screw 36 abuts against the inner wall of the flue 18 and thus securing the damper frame 22 to the top of the chimney flue. Furthermore, the installation of the chimney frame 22 on top of the chimney flue can be achieved without drilling, cutting or other modification of the chimney flue and can be done with common household tools.

The frame 22 with its downwardly depending flanges 30 is integrally constructed and comprises a metal stamping. Consequently, the downwardly depending flanges 30 are formed from material originally within the central frame opening 26 so that metal wastage is minimized. Furthermore, the stamped metal frame 22 is much less expensive in construction then the previously known cast metal frames.

With reference now to FIGS. 3 and 4, a generally rectangular door 40 is pivotally secured by hinges 42 to one side of the rectangular frame portion 24. The door 40, which is also preferably metal stamping includes a downwardly tapered portion 44 around its entire outer periphery while the central portion of the door 40 is generally planar. In addition, the door is dimensioned so that the door 40 covers the entire frame 22 as best shown in FIG. 1 and in phantom line in FIG. 4. With the door 40 pivotally mounted to the frame 22 in the previously described fashion the door is movable between an open position, shown in solid line in FIG. 4, and a closed position shown in phantom line in FIG. 4.

With reference now to FIGS. 3 and 4, a spring assembly 50 is provided between the frame 22 and door 40 and urges the door 44 toward its open position. In the preferred form of the invention, the spring assembly 50 comprises an L-shaped rod 52 having a long leg 54 and a short leg 56. The short leg 56 of the rod 52 is pivotally mounted to one of the frame flanges 30 by a bracket 58 which can be stamped from the flange 30. Conversely, the free end of the long leg 54 of the rod 52 is slidably secured to the door 40 by a second bracket 60 while a compression spring 62 on the rod 52 is entrapped between the brackets 58 and 60. In addition, the spring assembly 52 can be mounted either along a center line of the door 40, as shown in FIG. 3, or along one side of the door 40, as shown in FIG. 6, without deviation from the spirit or scope of the invention. The actual assembly of the spring assembly can be accomplished by the homeowner at the time of installation of the damper 10.

With reference now to FIGS. 2–4, a tension spring 70 is connected by a bracket 72 to the door 40 preferably adjacent the edge of the door 40 opposite from its hinged edge. An elongated chain 74, or other elongated member, is connected at one end to the free end of the tension spring 70 so that the chain 74 extends downwardly through the chimney flue 18 and has a free end 76 accessible through the fireplace opening 16. Thus, the door 40 can be moved to its closed position by pulling downwardly on the chain 74 from the fireplace opening 16.

With reference now to FIGS. 2, 3 and 5, in order to retain the door 40 in its closed position, a pin 80 is secured to one side of the fireplace opening 16 and has an outwardly extending portion 82 adapted to engage a loop 84 at the lower end of the chain 74 when the door is in its closed position. A second loop 86 (FIG. 3) is attached to the first loop 84 and facilitates the engagement and disengagement of the loop 84 from the pin 80. In addition, in the preferred form of the invention, the pin 80 includes a downwardly extending portion 88 to ensure that once the pin 80 is connected to the loop 84, the loop 84 cannot unintentionally disengage from the pin 80. The tension spring 70, of course, between the chain 74 and the door 40 enables the loop 84 to extend around this downwardly depending portion 88 of the pin 80 and still retain the door 40 in its closed position upon release of the chain 74.

From the foregoing, it can be seen that the present invention provides a damper constructed primarily of stamped metal parts which not only facilitates the installation of the damper but also reduces its manufacturing cost. Furthermore, the damper 40 is of such simple construction that it can be installed on a chimney by even an inexperienced person.

A still further advantage of the damper according to the present invention is that the door 40 completely covers the damper frame 22 and the downwardly tapered outer periphery of the door prevents water from accumulating either in the damper frame or on the top of the door.

Having described my invention, however, many modifications thereto will become apparent to those skilled in the art to which it pertains without deviation of the spirit of the invention as defined the scope of the appended claims.

I claim:

1. A damper attachable to the top of a chimney flue comprising:

a substantially rectangular stamped frame having a central opening, said frame having a portion dimensioned to flatly abut against the top of a chimney flue, means for attaching said frame to said flue, a door pivotally mounted to said frame and movable between an open and a closed position wherein in said closed position said door covers said opening whereas in said open position, said door is spaced apart from said opening, means for resiliently urging said door towards said open position, elongated means connected at one end to said door and extending downwardly through said chimney flue for moving said door between said open and said closed position, a bracket having a hole, said bracket secured to said door, and wherein said resilient urging means comprises a rod, means for pivotally securing one end of said rod to said frame, the other end of said rod being longitudinally slidably positioned through said hole in said bracket, a stop member secured adjacent said other end of said rod for retaining said rod within said bracket hole and so that said bracket abuts against said stop member when said door is in said open position, and a helical compression spring positioned around said rod and sandwiched in between said bracket and said pivotal securing means.

2. The invention as defined in claim 1 wherein said frame further comprises at least two flanges integrally formed with said frame, said flanges extending downwardly from opposite sides of the central opening and into the interior of the flue, and said attaching means comprises fastening means extending through said flanges for securing said flanges to the interior of the flue.

3. The invention as defined in claim 2 wherein said central opening is substantially rectangular in shape and said frame further comprises four flanges, one flange extending downwardly from each side of the opening.

4. The invention as defined in claim 1 and further comprising a resilient extenible member connected in series with the elongated means.

5. The invention as defined in claim 4 wherein said elongated means comprises a chain.

6. The invention as defined in claim 2 wherein said fastening means comprises a threaded member which threadably engages said flange.

7. The invention as defined in claim 1 wherein said door entirely covers said frame when in its closed position and wherein the door includes a downwardly tapered portion around its outer periphery.

8. The invention as defined in claim 1 and further comprising a sealant disposed in between said frame and the flue.

* * * * *